United States Patent [19]

Eckart

[11] 4,190,307

[45] Feb. 26, 1980

[54] ADAPTER

[75] Inventor: Manfred Eckart, Wuppertal, Fed. Rep. of Germany

[73] Assignee: Vorwerk Interholding GmbH, Wuppertal, Fed. Rep. of Germany

[21] Appl. No.: 932,917

[22] Filed: Aug. 11, 1978

[30] Foreign Application Priority Data

Aug. 17, 1977 [DE] Fed. Rep. of Germany ..... 2737013

[51] Int. Cl.[2] ..... H01R 39/00

[52] U.S. Cl. ..... 339/6 R; 15/41 R; 15/351; 174/86; 339/101; 339/182 RS

[58] Field of Search ..... 339/6 A, 6 R, 6 RL, 339/8 A, 8 R, 8 RL, 9 A, 9 R, 9 RY, 101, 182 RS; 15/144, 41 R, 351, 359, 371, 377, 415, 422; 174/86

[56] References Cited

U.S. PATENT DOCUMENTS 2,213,792 9/1940 Dow et al. ..... 15/377

*Primary Examiner*—Roy Lake
*Assistant Examiner*—DeWalden W. Jones
*Attorney, Agent, or Firm*—Michael J. Striker

[57] ABSTRACT

An adapter, particularly for detachably connecting an electrical floor-treating device to an operating appliance, includes a first housing having a first longitudinal axis, a first end portion to be connected to the operating appliance and a second end portion. The adapter further includes a second housing having a second longitudinal axis extending substantially transverse to the first axis, a third portion adapted to be mounted on the second end portion for rotation relative thereto and about the first axis. The second housing is adapted to be mounted on the treating device for pivotal movement relative thereto about the second axis and for rotational movement with the treating device about the first axis.

19 Claims, 4 Drawing Figures

ADAPTER

BACKGROUND OF THE INVENTION

This invention relates to electrical floor-treating devices.

More particularly, this invention concerns adapters for connecting a floor-treating device to an operating appliance.

It is known in the art to provide a floor-treating device, for example a vacuum cleaner, with an adapter to connect this device to an operating appliance. Usually, such an adapter establishes both electrical and air communications between the above-mentioned elements. The electrical wiring can be installed in a passage which is separated from an air-conduit passage (see for example German Pat. No. 1,291,066). The adapter is mounted with one of its ends on the operating appliance and is free to pivot only about one axis. Such a construction has the disadvantage that the adapter does not have liberty to rotate about two mutually perpendicular axes.

Usually, such a construction includes a first member mountable on the floor-treating device and a second member having one end connectable to the first member and the other end engageable with the operating appliance. The first member is provided with passages extending almost to the end of this second portion of the adapter. Such a construction makes it almost impossible to positively solve the problem of rotating the second and first portions relative to one another since the passages, during rotation, would most likely become obstructed by the electrical wires. Such situation is especially likely to occur since in such an arrangement there is used a rigid, inflexible type of electrical wire.

Another disadvantage of such an arrangement is that there has to be provided a separate closure for covering the area of contact between the electrical wires and their terminals.

Still another disadvantage of such an arrangement is the complicated task of leading the rigid, inflexible wires through the passage in the adapter and then to bend the wires by 90° to lead them further to the terminal board.

SUMMARY OF THE INVENTION

It is a general object of the present invention to avoid the disadvantages of the prior art adapters.

More particularly, it is an object of the present invention to provide such an adapter which will permit the desired pivoting movement of the treating device relative to the operating appliance about two mutually perpendicular axes.

Another object of the present invention is to provide such an adapter which will ensure that during pivoting of the treating device relative to the operating appliance no twisting of the electrical wires can occur.

In pursuance of these objects and others which will become apparent hereafter, one feature of the present invention resides in providing a first housing having a first longitudinal axis, a first end portion adapted to be connected to the operating appliance, a second end portion longitudinally spaced from said first end portion. A second housing is provided with a second longitudinal axis extending substantially transverse to said first axis, a third portion adapted to be mounted on said second end portion for rotation relative thereto and about said first axis. The second housing is provided with means for mounting the latter on the treating device for pivotal movement relative thereto about said second axis and for rotational movement with the treating device about said first axis.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
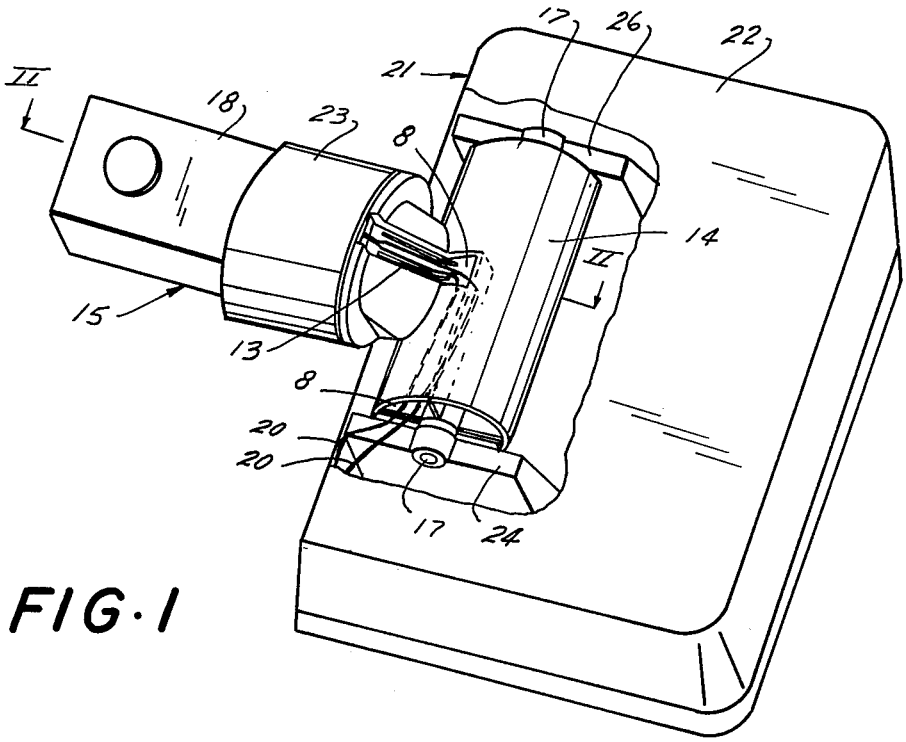
FIG. 1 is a perspective view of an adapter in accordance with the present invention.

Referring now to the drawings and first of all to FIG. 1 thereof, it may be seen that the reference numeral 15 designates an adapter in toto. The adapter 15 is mountable on a floor-treating device 21 which has a housing 22 (shown in FIG. 1 as partially sectioned).

The adapter 15 includes a first housing 18 having a first axis and a second housing 14 having a second axis extending substantially transverse to the first axis. The two housings are connected to one another by a coupling designated in toto by reference numeral 23.

Figure 2:
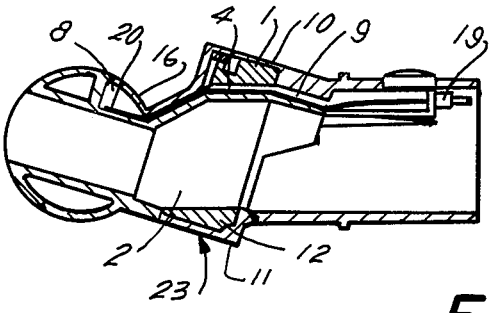
FIG. 2 is a sectional view taken on the line II—II of FIG. 1.

The coupling 23 includes an inner portion 1, that is a projection provided on the outer surface of the second housing 14, and an outer portion 10, that is an end portion of the first housing 18 (see FIG. 2).

The second housing 14 is further provided along its axis with two opposite projections 17 operative to be installed in the corresponding seats of supports 24 and 26 of the housing 22 of the treating device. It is to be understood that the second housing 14 is capable of pivotal movement relative to the treating device. The second housing 14 is provided with a passage 8 for passing therethrough electrical wires 20. As shown in FIG. 1, the passage 8 is provided with an intermediate portion having guide paths 13 for guiding the wires 20. This portion is closed by a separate closure 16 (see FIG. 2).

The flexible wires 20 extend through the passage 8, ring passage 4, a channel 9 and have one end connected to a motor (not shown), and the other end connected to terminals 19 (see FIG. 2).

As can be seen in FIG. 2, the first and second housings 18 and 14 respectively are provided with double walls. The first wall, that is the inner wall, bounds an air passage 2 which communicates with a suction source (not shown). Separated from the passage 2, a ring passage 4 is provided so as to circumferentially embrace the passage 2 over 180° of arc (see FIG. 3).

Figure 3:
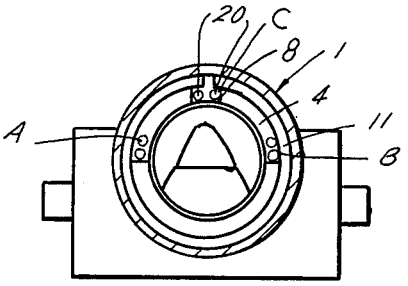
FIG. 3 is a side view partly in section of one portion of the adapter.

The wires 20 run from the passage 8 through the ring passage 4 and a channel 9 to the terminals 19. Should the inner portion 1 pivot relative to the outer portion 10 of the coupling 23, the flexible wires 20 move along the circumferential passage 4 in correspondence to the pivoting movement of the portions 10 and 1 relative to one another. FIG. 3 shows three such positions of the wires 20, that is positions A, B and C, which differ from one another by an angle of 90°.

It is also shown in FIG. 2 that the passage 2 and the passage 4 are sealed when the first and second housings are connected to one another along the end flanges 11 and 12 which are provided respectively on the first and second housings. The same flanges are shown separately in FIGS. 3 and 4.

The passage 8 is open into the ring passage 4, which in effect constitutes an extension of it but is enlarged to surround the passage 2 over 180° (see FIG. 1 and FIG. 2).

Figure 4:
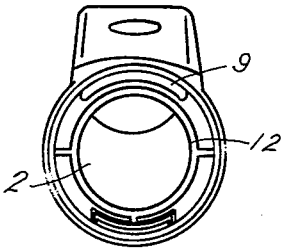
FIG. 4 is a side view of another portion of the adapter.

FIG. 4 shows the outer portion 10 of the coupling 23 which is provided with the air passage 2 and the channel 9, which extends around the passage 2 over about 90° of arc. This ensures that during rotation of the coupling 23 no twisting of the flexible wires 20 will occur. The wires 20 run through the channel 9 towards the terminals 19 (see FIG. 2). Thus, a reliable electrical connection is provided even during the rotation of the coupling 23.

It will be understood that each of the elements described above, or two or more together, may also find a useful application in other types of adapters differing from the types described above.

While the invention has been illustrated and described as embodied in an adapter, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An adapter, particularly for detachably connecting an electrical floor-treating device to an operating appliance, comprising a first housing having a first longitudinal axis, a first throughgoing passage and a second throughgoing passage separated from said first passage, a first end portion adapted to be connected to the operating appliance, and a second end portion longitudinally spaced from said first end portion; a second housing having a second longitudinal axis extending substantially transverse to said first axis of said first housing and a third portion adapted to be mounted on said second end portion of said first housing for rotation relative thereto and about said first axis, said second housing being further provided with one through-going passage corresponding to and adapted to communicate with said first passage of said first housing when the latter is connected to said second housing to thereby define an uninterrupted first channel through the adapter, and another throughgoing passage having an open end communicating with said second passage of said first housing when the latter is connected to said second housing and another end open outwardly of said second housing so as to define a second uninterrupted channel through the adapter; and means for mounting said second housing on the treating device for pivotal movement relative thereto about said second axis and for rotational movement with the treating device about said first axis.

2. An adapter as defined in claim 1; and further comprising means for electrically connecting the operating appliance with the treating device.

3. An adapter as defined in claim 2, wherein said electrical means include wires received in said second channel and having one end extending beyond said other open end of said other passage and the other end.

4. An adapter as defined in claim 3, wherein said second end portion of said first housing is provided with a circumferential recess having a cross-section substantially larger than that of said first passage, said recess being operative for rotatably receiving therein said third portion of said second housing.

5. An adapter as defined in claim 4; and further comprising means for sealing said first and second channels when said first and second housings are connected to one another.

6. An adapter as defined in claim 5, wherein said sealing means include a first circumferential projection within said recess, said third portion being provided with a second circumferential projection corresponding to and adapted to engage said first projection when said second housing is connected to said first housing.

7. An adapter as defined in claim 6; and further comprising means for limiting rotation of said second housing relative to said first housing and about said first axis.

8. An adapter as defined in claim 7, wherein said limiting means include a third circumferential projection in said recess of said first housing, said third projection being coaxial with said first projection and partially embracing the latter; said third portion being further provided with a groove coaxial with said second projection and partially embracing the latter, said groove being adapted to correspond and to movably receive therein said third projection when said second housing is connected to said first housing.

9. An adapter as defined in claim 8, wherein said third projection has a predetermined circumferential length substantially smaller than that of said groove so that said third projection can freely move within said groove until it abuts the corresponding end of said groove, thus limiting further rotation of said first and second housing relative to each other.

10. An adapter as defined in claim 9, wherein said groove extends by a length corresponding to 180° of arc around said second projection.

11. An adapter as defined in claim 10, wherein said one open end of said other passage is open into said groove.

12. An adapter as defined in claim 11, wherein said other passage has an intermediate portion at least partially exposed outwardly.

13. An adapter as defined in claim 12, wherein said intermediate portion is provided with means for guiding said wires from said one open end towards said other open end of said other passage.

14. An adapter as defined in claim 13; and further comprising a separate closure for closing said intermediate portion of said other passage from there-above.

15. An adapter as defined in claim 14, wherein said mounting means include at least two projections, each of them extending from the corresponding end face of said second housing.

16. An adapter as defined in claim 15, wherein said other end of the other passage of said second housing is open to both of said two projections.

17. An adapter as defined in claim 16, wherein said second passage so extends around said first passage of said first housing as to constitute an angle equal at least to 90°.

18. An adapter as defined in claim 17, wherein said second passage has one end open into said recess and the other end provided with terminals fixedly connected to said other end of said wires.

19. An adapter as defined in claim 18, wherein said electrical wires are flexible.

* * * * *